United States Patent [19]

Lipperts

[11] Patent Number: 4,636,600

[45] Date of Patent: Jan. 13, 1987

[54] VACUUM SWITCH PROVIDED WITH HORSESHOE-SHAPED ELEMENTS FOR GENERATING AN AXIAL MAGNETIC FIELD

[75] Inventor: Joseph H. F. G. Lipperts, Hengelo, Netherlands

[73] Assignee: Holec Systemen Componenten B.V., Hengelo, Netherlands

[21] Appl. No.: 712,737

[22] Filed: Mar. 18, 1985

[30] Foreign Application Priority Data

Mar. 19, 1984 [NL] Netherlands ..... 8400873

[51] Int. Cl.[4] ..... H01H 33/66

[52] U.S. Cl. ..... 200/144 B; 200/147 R

[58] Field of Search ..... 200/144 B, 147 R

[56] References Cited

FOREIGN PATENT DOCUMENTS 1930247 12/1970 Fed. Rep. of Germany .
2010587 6/1979 United Kingdom .
2072953 10/1981 United Kingdom .

*Primary Examiner*—Robert S. Macon

*Attorney, Agent, or Firm*—Watson, Cole, Grindle & Watson

[57] ABSTRACT

An electrical vacuum switch is provided with two mutually movable contacts of conductive material, mounted on the ends of a fixed or movable contact rod, with a laminated horseshoe-shaped ferromagnetic element being fitted around each contact rod. The magnetic circuit around the contact rod consists of a section of low magnetic resistance and a section of a high magnetic resistance. The circular base of the U-shaped inner cavity of the horseshoe-shaped element is adjacent to the associated contact rod and the elements are offset through 180° C. with respect to each other, so that the internal magnetic fields generated in the horseshoe-shaped elements when current passes through the switch, to the extent that the section with high magnetic resistance is approached, are mainly oriented axially between the two horseshoe-shaped elements. The elements are so designed that their magnetic resistance to the internal magnetic field increases in going from the U-shaped base section to the section with high magnetic resistance.

10 Claims, 10 Drawing Figures

VACUUM SWITCH PROVIDED WITH HORSESHOE-SHAPED ELEMENTS FOR GENERATING AN AXIAL MAGNETIC FIELD

BACKGROUND OF THE INVENTION

The invention relates to a vacuum switch provided with two contacts of electrically conductive material which can be moved towards and away from each other, mounted on the ends of a fixed or movable contact rod respectively of electrically conductive material, with a laminated horseshoe-shaped ferromagnetic element being fitted around each contact rod, as a result of which because of its position a magnetic circuit is formed, around the contact rod, which consists of a section of low magnetic resistance and a section of high magnetic resistance, the circular base of the U-shaped inner cavity of the horseshoe-shaped elements being adjacent to the associated contact rod and the elements being offset through 180° with respect to each other, so that the internal magnetic fields generated in the horseshoe-shaped elements when current passes through the switch, to the extent that the section with high magnetic resistance is approached, are mainly oriented axially between the two horseshoe-shaped elements.

A vacuum switch of this type is disclosed in Dutch Patent No. 168,361.

In this, in a very simple way, a powerful axial magnetic field is generated by means of the ferromagnetic horseshoe-shaped elements, with the result that the arc voltage is limited and the circuit-breaking characteristics of the vacuum switch are improved.

Although the ferromagnetic horseshoe-shaped elements according to the above-rated Dutch Patent show a marked improvement in relation to the arc voltage and consequently the switching performance of the vacuum switch, the latter still has a number of drawbacks.

Specifically, if there is a requirement to increase the arc voltage and consequently the circuit-breaking breaking capacity still further by intensifying the axial field, this would mean that the volume of the ferromagnetic horseshoe-shaped elements would have to increase. However, in view of the position of the ferromagnetic horseshoe-shaped elements within the switch, such an increase would at the same time imply that the dimensions of the switch would increase. However, this is incompatible with the general aim of keeping the dimensions of the vacuum switches as limited as possible. In addition, the mass of the movable contact will then likewise increase, which would place higher demands on the drive mechanism and lead to an increased tendency for the contacts to rumble on closing.

SUMMARY OF THE INVENTION

The object of the invention is therefore to provide a vacuum switch of the type discussed previously which has been further improved in a manner such that the circuit-breaking capacity is increased without the adverse effects mentioned occurring. The vacuum switch according to the invention is to this effect characterised in that the horseshoe-shaped elements are so designed that their magnetic resistance to the internal magnetic field increases in going from the U-shaped base section to the section with high magnetic resistance.

According to a further embodiment of the vacuum switch according to the invention the latter is characterised in that the internal magnetic field encounters a magnetic resistance which increases as the distance from the U-shaped base section increases relative to the distance from the contact surface.

In a preferred embodiment of the vacuum switch according to the invention each horseshoe-shaped element is bounded on the one side by a flat boundary surface which is perpendicular to the contact rod and is placed at the side of the contact surface, and is bounded on the other side by a boundary surface which, going from the U-shaped base section towards the section with high magnetic resistance, approaches the above-named flat boundary surface.

According to the present invention material with a high saturation induction, such as, for example, pure iron, is chosen for the ferromagnetic material of the horseshoe-shaped elements. By alloying pure iron with cobalt the material at the same time acquires a higher electrical resistance. By preference, the material FeCo 50/50 is chosen from the range of possibilities because this material combines a high saturation induction with a high electrical resistance.

The invention will now be explained in more detail by reference to the drawings in which exemplary embodiments are shown.

FIGS. 1*a* and 1*b* show a vacuum switch as disclosed in the noted Dutch Patent;

DETAILED DESCRIPTION OF THE PREFERRED EMBODIMENTS

Figure 1A:
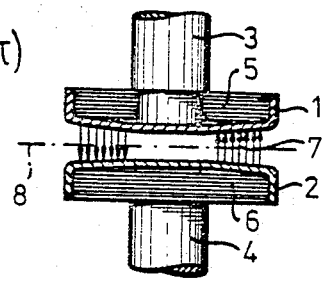
Fig-1a (PRIOR ART)

As is evident from FIG. 1*a*, the contacts 1 and 2 are provided with ferromagnetic horseshoe-shaped elements 5 or 6 respectively situated behind them. The contacts 1 and 2, along with the associated ferromagnetic horseshoe-shaped elements 5 and 6, are mounted on contact rods 3 or 4, respectively, by means of which they can be brought into contact with each other or separated from each other.

Figure 1B:
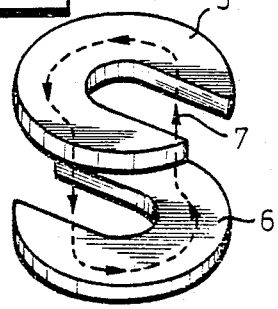
Fig-1b (PRIOR ART)

If a current then flows through the switch, it will induce an internal magnetic field in the ferromagnetic horseshoe-shaped elements 5 and 6, i.e., running concentrically around the contact rod, which magnetic field, however, as a result of the shape and arrangement of the horseshoe-shaped elements will gradually and to a large extent be converted into an axially oriented magnetic field 7, which improves the arc-quenching characteristics of the vacuum switch. The axial magnetic field 7 will run approximately as indicated in FIG. 1*b* between the horseshoe-shaped elements 5 and 6.

Figure 2:
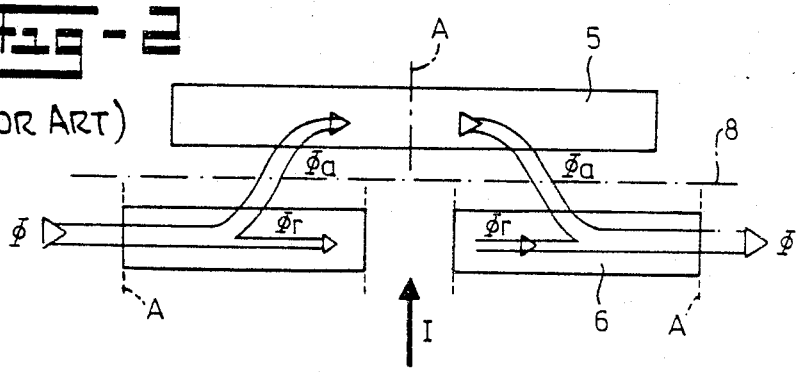
Fig-2 (PRIOR ART)
FIG. 2 shows the path of the flux components in the switch according to FIG. 1.

In FIG. 2 the two ferromagnetic horseshoe-shaped elements 5 and 6 from FIG. 1 are drawn in sectional form one above the other. The contact surface 8 lies between them and is shown by a dotted line.

As has already been noted previously, the magnetic field $\Phi$ induced by the current I through the switch in, for example, the ferromagnetic horseshoe-shaped element 6 will be split into an internal component $\Phi_r$ running mainly through the ferromagnetic horseshoe-shaped element and an axial component $\Phi_a$ crossing over to the other ferromagnetic horseshoe-shaped element 5.

The total magnetic flux at the position of the cross-sectional line A, i.e., at the position of the U-shaped base section, will be directed, entirely in the longitudinal direction of the U-shaped element, concentrically around the contact rod, but as a result of the axial component $\Phi_a$ will gradually decrease as the distance relative to this cross-sectional line A increases. As a result, at the position of the section with a high magnetic resistance in the ferromagnetic horseshoe-shaped elements, only a relatively small flux component $\Phi_r$ will remain. This means, however, that the ferromagnetic horseshoe-shaped elements 5 and 6 cannot be optimally used with regard to the magnetic saturation because the section at the position of the cross-sectional line A will have long reached the magnetic saturation point, whereas this is far from being the case at the position of the sections which border on the sections with high magnetic resistance. Because of this saturation the total field $\Phi$ in the horseshoe-shaped element cannot increase further and consequently, neither can the axial field $\Phi_a$.

In order now to be able to increase the axial magnetic field, it should be possible to increase the total volume of the ferromagnetic horseshoe-shaped elements, as a result of which the magnetic saturation point will only be reached at a higher longitudinal flux component $\Phi_r$ and consequently the axial flux component $\Phi_a$ will also be able to have a higher value. The increase in the volume of the ferromagnetic horseshoe-shaped elements can only be achieved by increasing the dimensions in the axial direction because the radial dimensions are determined mainly by the associated contacts.

Apart from the drawbacks mentioned in the introduction with regard to the dimensions and the total weight of the contact assembly and the inefficient use of the ferromagnetic horseshoe-shaped elements outlined above, the useful axial flux component $\Phi_a$ in that case then will, however, moreover increase to a lesser extent than the flux component $\Phi_r$, which means that the efficiency of the total flux $\Phi$ decreases. Specifically, as a result of the horseshoe-shaped element becoming thicker, the magnetic resistance of the open section will decrease as a result of the increased surface area, so that more flux $\Phi_r$ will cross over at this point. This will take place at the expense of the axial flux component $\Phi_a$.

Figure 3:
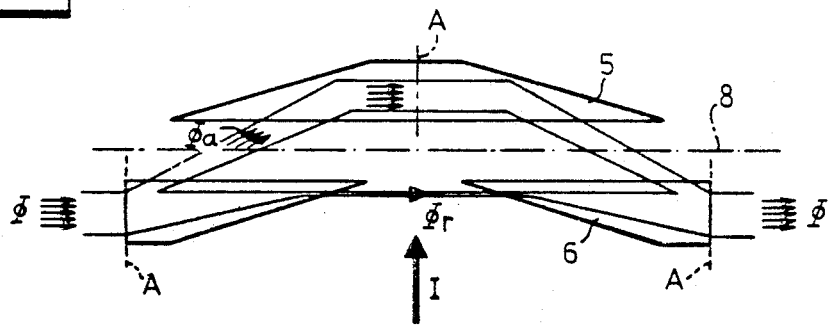
FIG. 3 shows the path of the flux components in the switch according to the invention.

In FIG. 3 the two ferromagnetic horseshoeshaped elements 5 and 6 according to a preferred embodiment of the invention are shown above each other in sectional form in a similar manner to FIG. 2, with the contact surface 8 again lying between these two horseshoe-shaped elements.

The shape shown in FIG. 3 not only results in the ferromagnetic horseshoe-shaped elements being optimally used with respect to the magnetic saturation point, while the weight of the contact assembly is at the same time decreased, but the axial flux component $\Phi_a$ will increase markedly without any change in the dimensions in the axial direction and for the same total flux $\Phi$. This is easy to see by reference to FIG. 3 because the magnetic resistance to the flux component $\Phi_r$ has sharply increased, while the resistance to the axial flux component $\Phi_a$ has remained constant. Consequently, a larger component of the total magnetic flux will flow in the axial direction. In this way, according to the invention a marked improvement in the characteristics of the vacuum switch named in the introduction can be achieved in a very simple manner.

Of course, this improvement is not limited to the use of a magnetic field for improving the arc-quenching action of a switch, but can also be used to achieve an improvement in those cases where a switch current is used to generate magnetic repulsion or attraction forces between the contacts.

Figure 4:
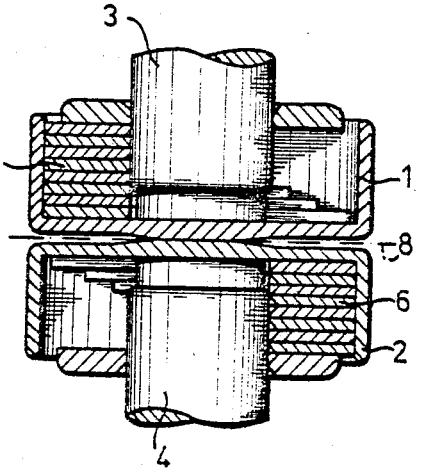
FIG. 4 shows an exemplary embodiment of the switch according to the invention.

FIG. 4 shows a contact assembly according to the invention in which use is made of platelets of ferromagnetic material stacked on top of each other. 8 again indicates the contact surface between the two contacts 1 and 2. 3 and 4 are the respective associated contact rods, around which the horseshoe-shaped elements, consisting of platelets stacked on top of each other, are fitted. These platelets can be joined to each other by means of a rivet, pin or similar device, while the dimensions in the axial direction can be varied by using more or less platelets.

Figure 5:
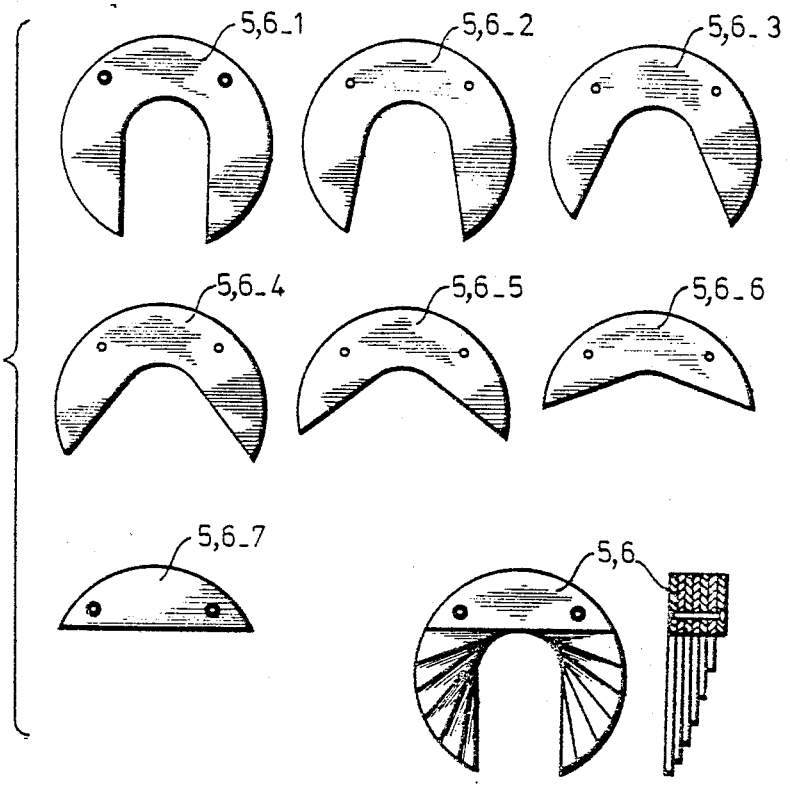
FIG. 5 shows a possible form of embodiment and construction of a horseshoe-shaped element made up of horizontal laminations.

FIG. 5 shows by way of example how the various platelets can be shaped. From the stacked assembly it is evident that the magnetic resistance to the internal longitudinal flux component will also increase sharply in this case, as the distance from the middle section, where the horseshoe-shaped element is thickest, increases. In this case, therefore, the shape shown in FIG. 3 is approached.

Figure 6:
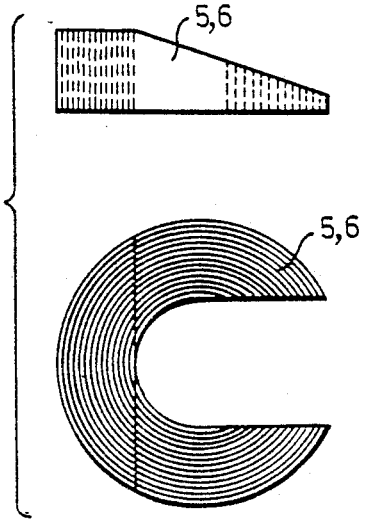
FIG. 6 shows the possible form of embodiment and construction of a horseshoe-shaped element made up of vertical, wound laminations.

FIG. 6 shows a ferromagnetic horseshoe-shaped element according to another preferred form of embodiment of the present invention in which the platelets are bent coaxially around the contact rod.

An element of this type can be manufactured in a simple manner by winding a roll of ferromagnetic tape or strip material successively around a former, the internal diameter of the former being of dimensions such that the contact rod fits into it. In a suitable manner, for example by enclosure in a casing, steps are then taken to ensure that the windings remain together. The section with a high magnetic resistance can then be introduced by removing a part of the wall of the roll, for example by milling, and, finally, increasing the magnetic resistance to the internal longitudinal component of the field by tapering the roll.

Figure 7:
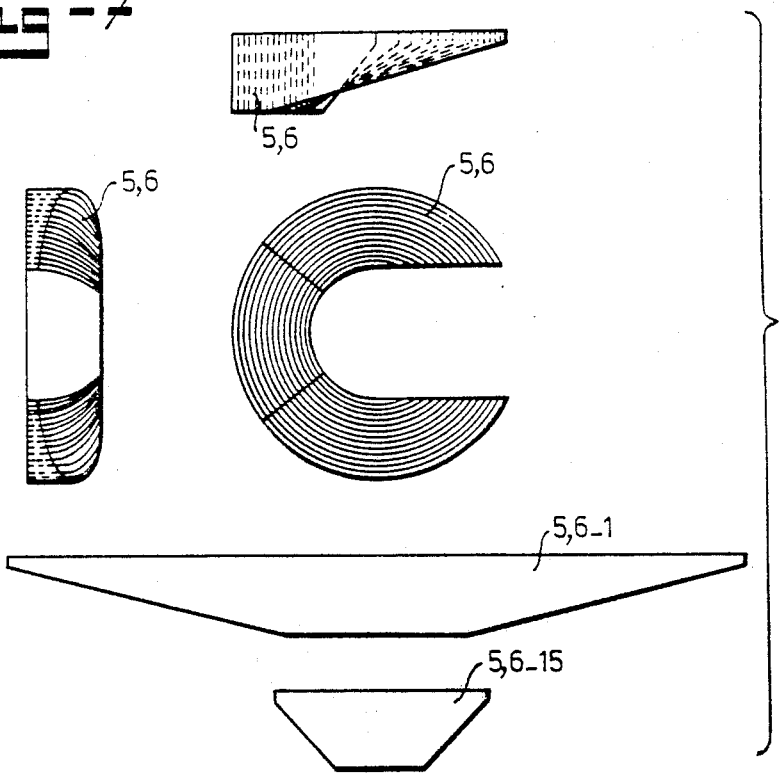
FIG. 7 shows the possible form of embodiment and construction of an element made up of vertical, concentric laminations.

Another possibility is shown in FIG. 7. Here again the ferromagnetic horseshoe-shaped element is formed from platelets which in this case, however, are fitted in the axial direction coaxially around the contact rod. The platelets are specially shaped according to a definite pattern and then bent to the desired form and again secured to each other, for example by means of rivets.

At the bottom of FIG. 7 the innermost and outermost platelets are shown opened up by way of example. The advantage of this option over the one in FIG. 6 is that the shape of the final ferromagnetic horseshoe-shaped element can be matched to diverging requirements.

Figure 8:
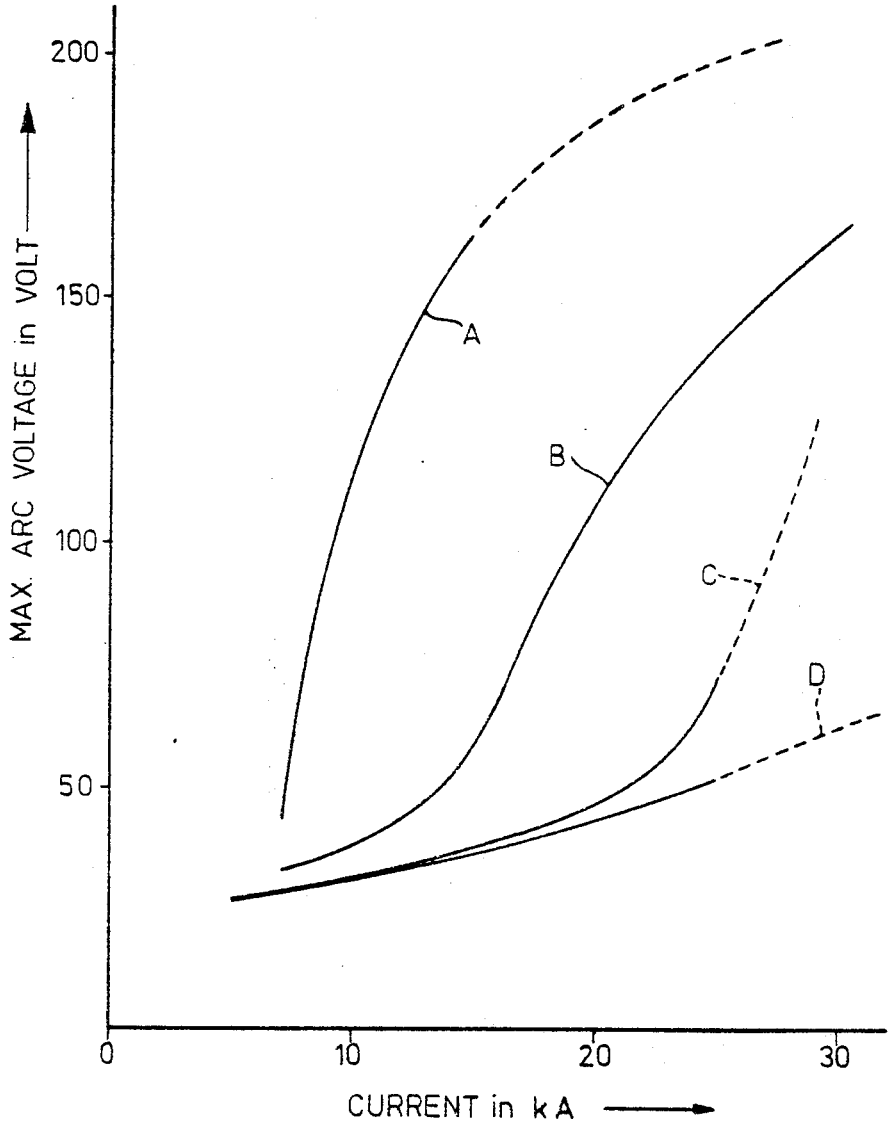
FIG. 8 shows the maximum arc voltage as a function of the current in the case of vacuum switches according to the state of the art and according to the invention.

In FIG. 8 the maximum arc voltage in V is shown as a function of the current through the switch in kA for a vacuum switch without axial field (curve A), for a switch with unlaminated ferromagnetic horseshoe-shaped elements (curve B), for a switch with laminated ferromagnetic horseshoe-shaped elements (curve C), and finally for a vacuum switch with horseshoe-shaped elements according to the invention (curve D). The curve C is derived for a vacuum switch according to the introduction of the present patent application. Curve D shows the reduction in the arc voltage as the interrupted current increases when the measures according to the present invention are adopted. The measurement points for curves C and D only go up to 25 kA. However, by extrapolation it can be inferred that especially in the case of curve D the arc voltage remains at a very low level even for very high currents. This extrapolation is permissible because of the rapid or slow increase in the saturation for the various forms of embodiment of the horseshoe-shaped elements respectively.

In contrast to the requirements imposed on most materials with magnetic properties, it is not the steepness of the curve which is important, but the high saturation induction. Because of this pure iron is to be preferred to the much-used so-called transformer lamination. As a result of this high saturation induction the ferromagnetic horseshoe-shaped elements can be smaller for a given flux than for materials with a lower saturation induction.

It is also of importance that the material has a high electrical resistance since this allows thicker laminations to be used without troublesome eddy currents developing. As a result the ferromagnetic element can be built up from fewer laminations, which is of advantage from the production engineering viewpoint. To obtain a higher electrical resistance while retaining a good saturation induction, much use is made of iron-cobalt alloys such as the so-called Vacoflux 24S2 with a cobalt content of 24% or FeCo 50/50 with a cobalt content of 50%, which is to be preferred.

Figure 9:
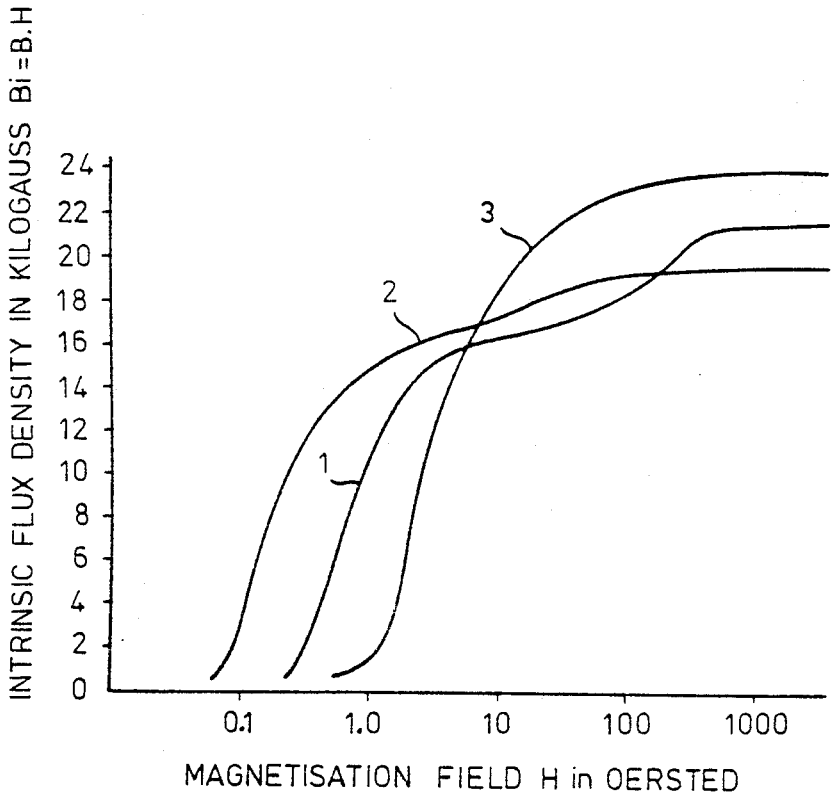
FIG. 9 shows a number of magnetization curves for the purpose of further explanation.

In FIG. 9 the magnetisation curves have been drawn for a number of materials. In contrast to the requirements imposed on most materials with magnetic properties, it is not the steepness of the curves which is important, but the high saturation induction achievable. Because of this pure iron (curve 1) is to be preferred to the much-used so-called transformer lamination (curve 2) consisting of 3% silicon steel. As a result of this high saturation induction the ferromagnetic horseshoe-shaped elements can be smaller for a given flux.

It is also of importance that the material has a high electrical resistance because this allows thicker laminations to be used without troublesome eddy currents developing. As a result the ferromagnetic element can be built up from fewer laminations, which is an advantage from the production engineering viewpoint. A material which is to be preferred from this point of view is, for example, FeCo 50/50 (curve 3) which possesses both a high saturation induction and a high electrical resistance.

It goes without saying that the invention is not limited to the forms of embodiment described above and shown in the Figures, but that modifications are possible without going outside the scope of the invention.

I claim:

1. Electrical vacuum switch provided with two contacts of electrically conductive material which can be moved towards and away from each other, mounted on the ends of a fixed or movable contact rod respectively of electrically conductive material, with a laminated horseshoe-shaped ferromagnetic element being fitted around each contact rod, as a result of which because of the position a magnetic circuit is formed around the contact rod, which circuit consists of a section of low magnetic resistance and a section of a high magnetic resistance, the circular base of the U-shaped inner cavity of the horseshoe-shaped elements being adjacent to the associated contact rod and the elements being offset through 180° with respect to each other, so that the internal magnetic fields generated in the horseshoe-shaped elements when current passes through the switch, to the extent that the section with high magnetic resistance is approached, are mainly oriented axially between the two horseshoe-shaped elements, wherein the horseshoe-shaped elements are so designed that their magnetic resistance to the internal magnetic field increases in going from the U-shaped base section to the section with high magnetic resistance.

2. Vacuum switch according to claim 1, wherein the internal magnetic field encounters a magnetic resistance which increases as the distance from the U-shaped base section increases relative to the distance from the contact surface.

3. Vacuum switch according to claim 1 or 2, wherein each horseshoe-shaped element has a flat boundary surface, which is perpendicular to the contact rod and is placed at the side of the contact surface, and a boundary surface which, going from the U-shaped base section towards the section with high magnetic resistance, approaches the flat boundary surface.

4. Electrical vacuum switch according to claim 3, wherein the laminated ferromagnetic horseshoe-shaped elements are constructed from ferromagnetic platelets lying parallel to the flat boundary surface in a stack, of which the legs which bound the U-shaped inner cavity enclose an angle which increases as the distance from the contact surface increases.

5. Electrical vacuum switch according to claim 3, wherein the laminated ferromagnetic horseshoe-shaped elements are made up of ferromagnetic platelets fitted around the contact rod and forming coaxial cylindrical parts, the axial dimensions of which, measured from the flat boundary surface, decrease in going from the circular base of the U-shaped inner cavity to the open extremity.

6. Vacuum switch according to claim 5, wherein the ferromagnetic platelets forming the coaxial cylindrical parts are concentric.

7. Vacuum switch according to claim 5, wherein the ferromagnetic platelets forming the coaxial cylindrical parts are of spiral shape.

8. Laminated horseshoe-shaped element for use in the vacuum switch according to claim 1, wherein the ferromagnetic material of said element has a high saturation induction.

9. Laminated horseshoe-shaped element according to claim 8, wherein the ferromagnetic material has at the same time a high electrical resistance, and consists, for example, of FeCo 50/50.

10. Laminated horseshoe-shaped element according to claim 8, wherein said ferromagnetic material is pure iron.

* * * * *